US010494840B2

(12) United States Patent
Kobayashi

(10) Patent No.: US 10,494,840 B2
(45) Date of Patent: Dec. 3, 2019

(54) BRACKET STRUCTURE

(71) Applicant: HONDA MOTOR CO., LTD., Tokyo (JP)

(72) Inventor: Jun Kobayashi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/028,572

(22) Filed: Jul. 6, 2018

(65) Prior Publication Data

US 2019/0010738 A1 Jan. 10, 2019

(30) Foreign Application Priority Data

Jul. 7, 2017 (JP) ..... 2017-134136

(51) Int. Cl.

| | |
|---|---|
| ***E05B 79/08*** | (2014.01) |
| ***E05B 15/16*** | (2006.01) |
| ***E05B 85/02*** | (2014.01) |
| ***E05B 79/20*** | (2014.01) |

(52) U.S. Cl.

CPC ..... *E05B 79/08* (2013.01); *E05B 15/1635* (2013.01); *E05B 79/20* (2013.01); *E05B 85/02* (2013.01); *E05B 2015/1664* (2013.01)

(58) Field of Classification Search

CPC ..... E05B 79/08; E05B 79/00; E05B 79/02; E05B 79/04; E05B 79/06; E05B 79/20; E05B 79/10; E05B 79/18; E05B 79/22; E05B 79/16; E05B 15/1635; E05B 85/02; E05B 2015/1664

USPC ..... 248/551, 553

See application file for complete search history.

(56) References Cited

U.S. PATENT DOCUMENTS 3,766,759 A * 10/1973 Artner ..... B60R 11/0205 248/318
7,077,374 B1 * 7/2006 Johnson ..... B65D 85/68 206/335
7,121,369 B2 * 10/2006 Beck ..... B60K 11/04 180/68.4
8,146,394 B2 * 4/2012 Krueger ..... E05B 5/00 292/DIG. 31
9,284,748 B2 * 3/2016 Le ..... E05B 41/00
9,512,636 B2 * 12/2016 Czeresko, Jr. ..... E05B 5/00

(Continued)

FOREIGN PATENT DOCUMENTS

JP H11-345631 A 12/1999
JP 2000-045586 A 2/2000

(Continued)

OTHER PUBLICATIONS

Japanese Office Action with English translation dated Jan. 8, 2019, 11 pages.

(Continued)

*Primary Examiner* — Nkeisha Smith
(74) *Attorney, Agent, or Firm* — Rankin, Hill & Clark LLP

(57) ABSTRACT

A bracket structure is provided with a casing formed of a resin material, and the casing includes a mounting part formed so as to allow an engaged part to be mounted thereon, the engaged part being operated by engagement with an engaging part, and a frame-shaped part that is erected from a peripheral edge of the mounting part to be continuously formed in a peripheral direction thereof.

3 Claims, 4 Drawing Sheets

(56) References Cited

U.S. PATENT DOCUMENTS

| | | | | |
|---|---|---|---|---|
| 2003/0111849 | A1* | 6/2003 | Lee | E05B 85/18 292/336.3 |
| 2010/0077567 | A1 | 4/2010 | Makino et al. | |
| 2015/0368937 | A1* | 12/2015 | Da Deppo | E05B 85/16 292/336.3 |
| 2016/0137041 | A1* | 5/2016 | Dylewski, II | E05C 9/085 292/197 |

FOREIGN PATENT DOCUMENTS

| | | | |
|---|---|---|---|
| JP | 2009-072606 | A | 4/2009 |
| JP | 2010-077717 | A | 4/2010 |
| JP | 2010-115191 | A | 5/2010 |
| JP | 2016-008381 | A | 1/2016 |

OTHER PUBLICATIONS

Japanese Office Action with English translation dated Jul. 23, 2019 (6 pages).

* cited by examiner

BRACKET STRUCTURE

CROSS-REFERENCE TO RELATED APPLICATION

This application is based upon and claims priority from the Japanese Patent Application No. 2017-134136, filed on Jul. 7, 2017, the entire contents of which are incorporated herein by reference.

BACKGROUND OF THE INVENTION

1. Field of the Invention

The present invention relates to a bracket structure.

2. Description of the Related Art

As one example of conventional bracket structures, there is a known bracket that includes a knob or a key cylinder for manually opening a lid for a security space such as a trunk or a door (see, for example, Patent document 1: Japanese Unexamined Patent Application Publication No. 2009-72606).

The conventional bracket structure has made it difficult to sufficiently secure rigidity when attempting to change materials composing the bracket from metal such as iron to a resin material.

The present invention has therefore been made in view of the above problem, and an object of the present invention is to provide a bracket structure capable of securing sufficient rigidity even if a resin material is used.

SUMMARY OF THE INVENTION

In order to solve the above problem, according to an aspect of the present invention, a bracket structure reflecting one aspect of the present invention includes a casing formed of a resin material, the casing including: amounting part that is formed so as to allow an engaged part to be mounted thereon, the engaged part being operated by engagement with an engaging part; and a frame-shaped part that is erected from a peripheral edge of the mounting part to be continuously provided in a peripheral direction thereof.

BRIEF DESCRIPTION OF THE DRAWINGS

The features and advantages provided by one or more embodiments of the invention will become apparent from the detailed description given below and appended drawings which are given only by way of illustration, and thus are not intended as a definition of the limits of the present invention.

DETAILED DESCRIPTION OF THE PREFERRED EMBODIMENTS

Hereinafter, one or more embodiments of the present invention will be described with reference to the drawings as necessary. In the description below, the same component is given the same reference sign and thus duplicate description is omitted. When a direction is described, the description will be given based on "front", "rear", "left", "right", "up" and "down" when viewed from a driver in a vehicle. Moreover, a "vehicle width direction" is synonymous with a "right-left direction".

Figure 8:
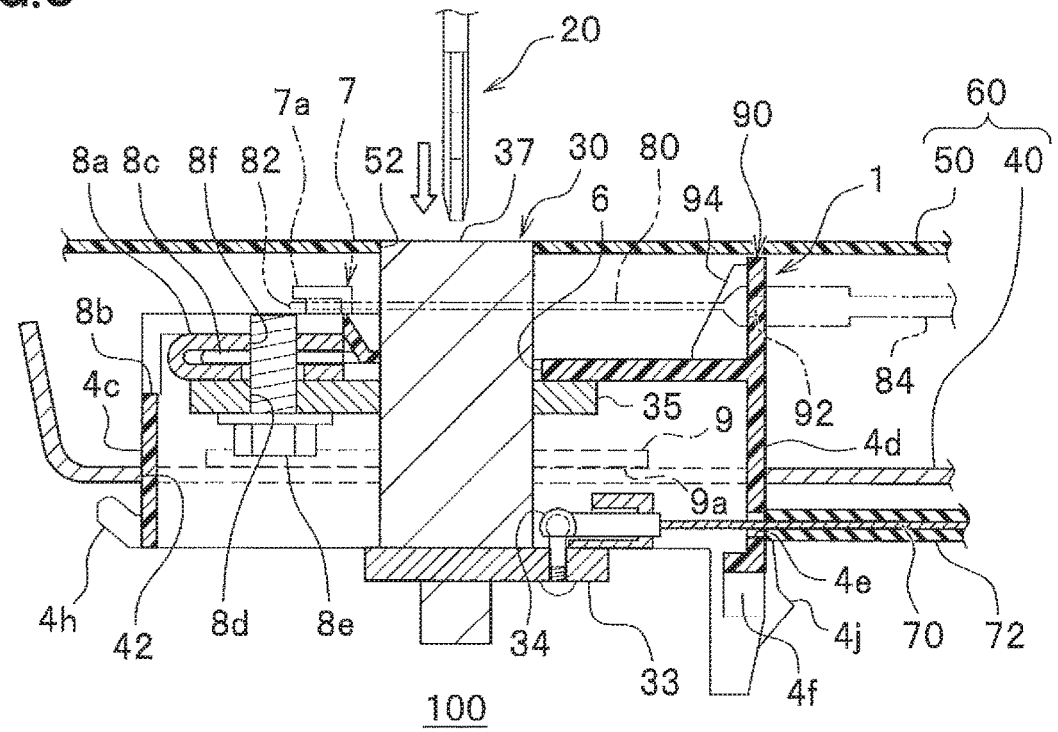
FIG. 8 is a cross-sectional view taken along the line VIII-VIII in FIG. 2 that shows the configuration of the resin-made bracket.

First, referring to FIG. 8, a vehicle body side mounting part 60 is provided in an opening of a vehicle 100. The vehicle body side mounting part 60 includes a first panel 40 and a second panel 50 which are made of metal. In the present embodiment, the first panel 40 is an inner panel of the body, and the second panel 50 is a lining panel. Moreover, the vehicle body side mounting part 60 is provided with a knob (not shown), or a key cylinder 30 that forms a counterpart to a key 20, for manually opening a lid for a security space such as a trunk or a door.

The knob or the key cylinder 30 is mounted via a bracket on the first panel 40 or the second panel 50 provided inside the vehicle body side mounting part 60.

On the other hand, to the key 20 serving as an engaging part and the key cylinder 30 serving as an engaged part that is operated by engagement with the key 20, stresses are applied from various directions during locking and unlocking operations. In particular, when an input in a turning direction is applied to a bracket 1 from the key cylinder 30, a stress in a torsional direction is applied to the bracket 1 that mounts the key cylinder 30 on the vehicle body.

Therefore, the bracket 1 is required securing sufficient rigidity so as not to be deformed or damaged even if it receives such a stress in the torsional direction.

Figure 1:
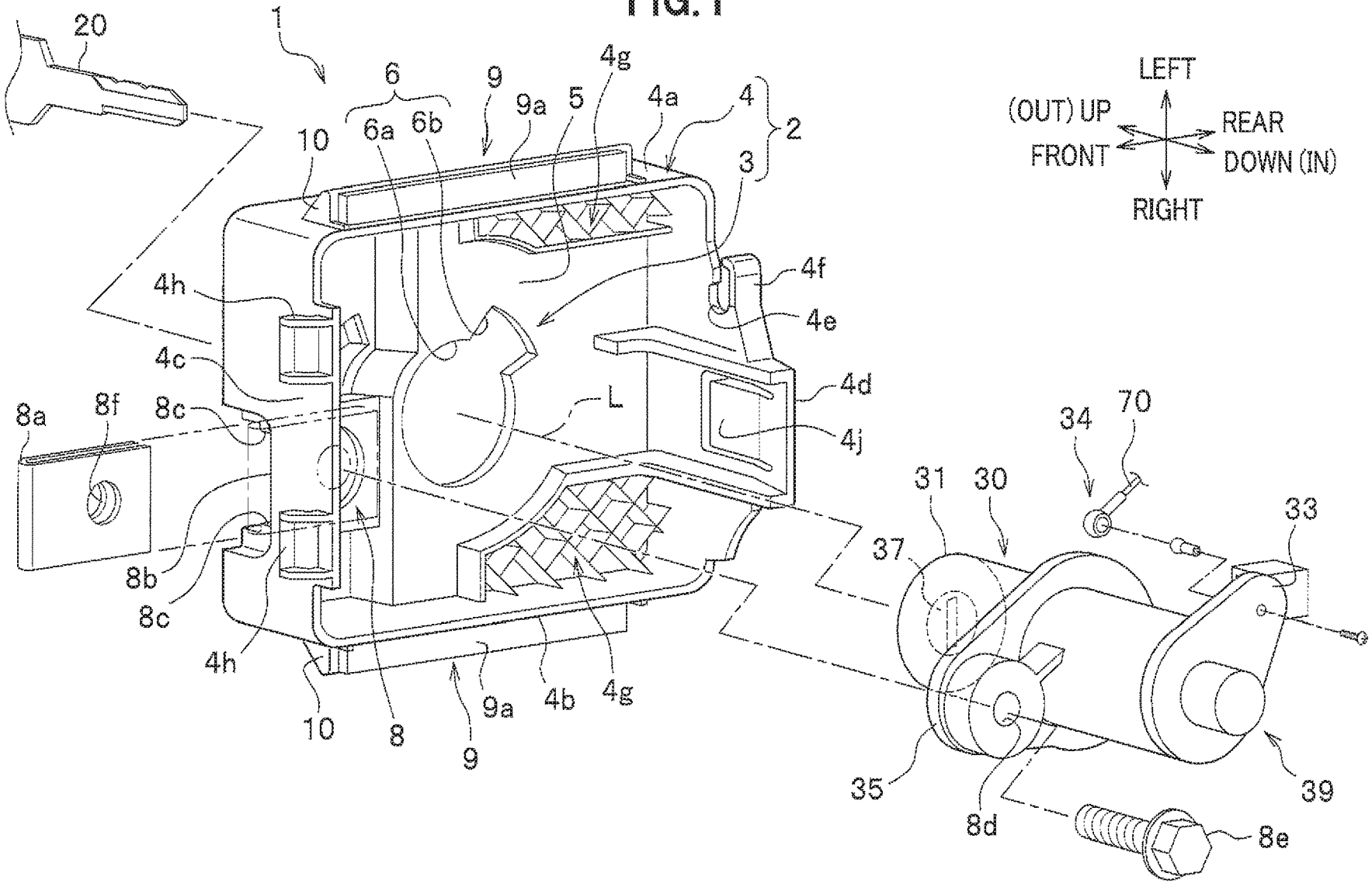
FIG. 1 is an exploded perspective view showing a bracket structure according to an embodiment of the present invention.

As shown in FIG. 1, the bracket 1 in the present embodiment is provided with a casing 2 formed of a resin material. The casing 2 includes a mounting part 3 and a frame-shaped part 4.

Among these parts, the mounting part 3 includes a base board 5 having a nearly rectangular shape, an engaging hole 6 formed nearly in the center of the base board 5, a cable locking part 7 (see FIG. 2) that is provided on a vehicle outer side face of the base board 5 and to be described below, and a fixing part 8.

The base board 5 has a vehicle inner side face formed into a planar shape as shown in FIG. 1. Moreover, the vehicle outer side face of the base board 5 is formed with a planar part 5*a*, and a pedestal part 5*b* that is formed to have a higher step than and contiguous to the planar part 5*a* (see FIG. 2).

The engaging hole 6 is composed of a round hole 6*a* through which the key cylinder 30 is inserted, and a rectangular cut-out part 6*b* provided contiguous to the round hole 6*a*. The cut-out part 6*b* is formed into a predetermined size so as to allow a projection 32 (see FIG. 3) that is engaged with a peripheral edge of the round hole 6*a*, to be inserted through the cut-out part 6*b*.

Moreover, the key cylinder 30 to be engaged with the key 20 is inserted into the engaging hole 6 formed in the base board 5 from the vehicle inner side, and allows a fixing flange piece 35 that is firmly fixed to an outside case 31, to be butted against the base board 5. With this state, the key cylinder 30 is turned around a cylinder shaft. The projection 32 is engaged with the opening peripheral edge of the round hole 6*a* from the vehicle outer side. Consequently, the key cylinder 30 is mounted on the bracket 1 with the opening peripheral edge of the round hole 6*a* being sandwiched between the projection 32 of the key cylinder 30 and the fixing flange piece 35.

On the other hand, the frame-shaped part 4 is provided integral with the base board 5 so as to be erected from a peripheral edge of the base board 5 in the mounting part 3 to be continuously formed in the peripheral direction. The frame-shaped part 4 in this embodiment is formed into a nearly rectangular shape when viewed in the engagement direction along a cylinder axial direction L. Moreover, the frame-shaped part 4 is configured to allow the erected dimension to have nearly the same height position as a height dimension of an end part 39 on an opposite side of a front end face 37 in the state of the key cylinder 30 being mounted on the mounting part 3. Consequently, the bracket 1 is formed to have a nearly box-shaped form in which one side face on the vehicle inner side thereof is open as shown in FIG. 8.

Moreover, as shown in FIG. 1, the frame-shaped part 4 has lattice-like distortion reinforcing parts 4*g*, 4*g* provided inside corner parts thereof. The distortion reinforcing parts 4*g*, 4*g* are adapted to suppress generation of distortion or deformation such that the frame-shaped part 4 is distorted from its original nearly rectangle into a parallelogram.

In this embodiment, the lattice-like distortion reinforcing parts 4*g*, 4*g* are provided inside the corner parts that are located on the opposite side of the fixing part 8. Moreover, the distortion reinforcing parts 4*g*, 4*g* are disposed together with a stepped part of the pedestal part 5*b* to be described later, so as to surround an insertion part 4*e* and the circumference of the mounting part 3 to the fixing part 8 in a channel shape when viewed in the engagement direction along the cylinder axial direction L. Consequently, the inside of the frame-shaped part 4 is efficiently reinforced.

The frame-shaped part 4 in this embodiment has a pair of side wall parts 4*a*, 4*b* facing each other across the mounting part 3 and having mounting flanges 9, 9 provided along the peripheral direction on outer faces thereof, respectively. The mounting flanges 9, 9 are formed along the peripheral direction on the outer faces of the side wall parts 4*a*, 4*b* so as to be nearly parallel with the planar part of the base board 5 and to be perpendicular to the side wall parts 4*a*, 4*b*, respectively. Moreover, the mounting flanges 9, 9 are configured to allow planar abutting faces 9*a*, 9*a* thereof to abut on the vehicle outer side face of the first panel 40.

Figure 2:
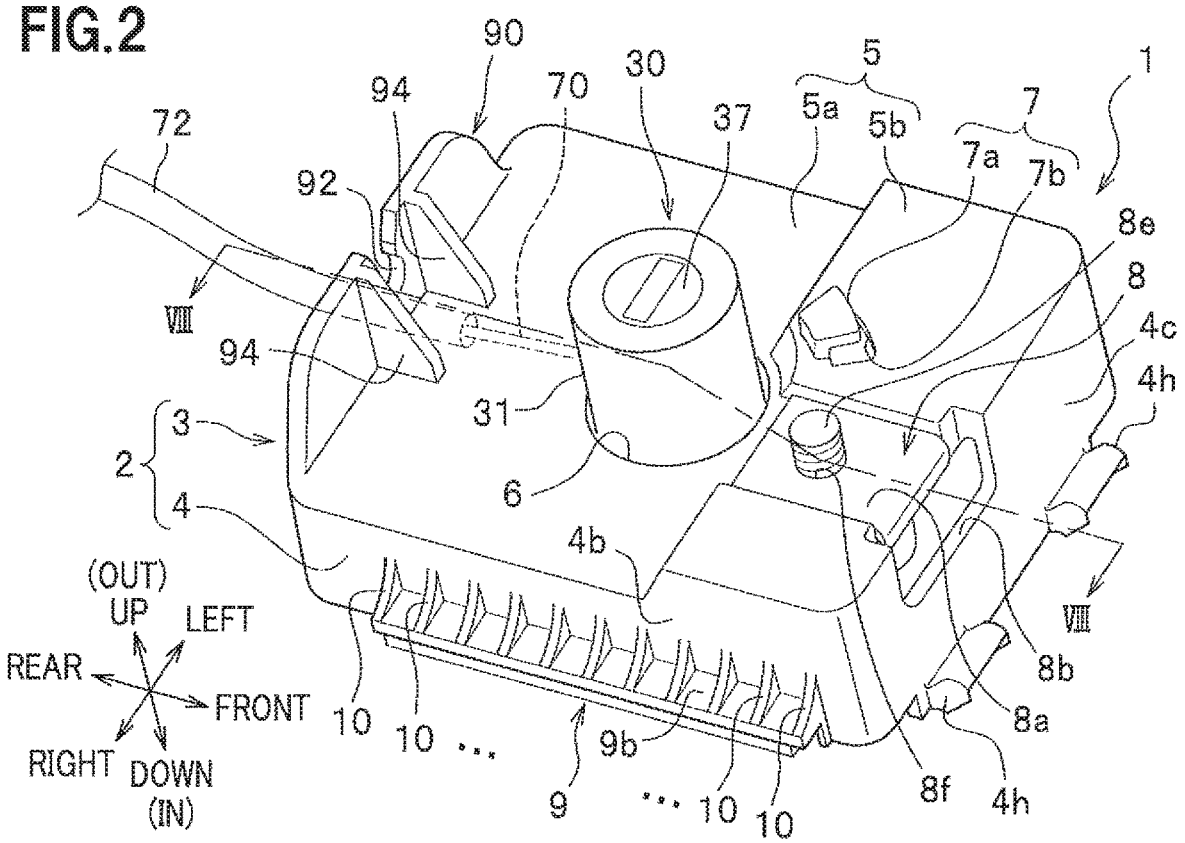
FIG. 2 is a perspective view showing a vehicle outer side face, as viewed from one side, of a resin-made bracket in the embodiment.
Figure 3:
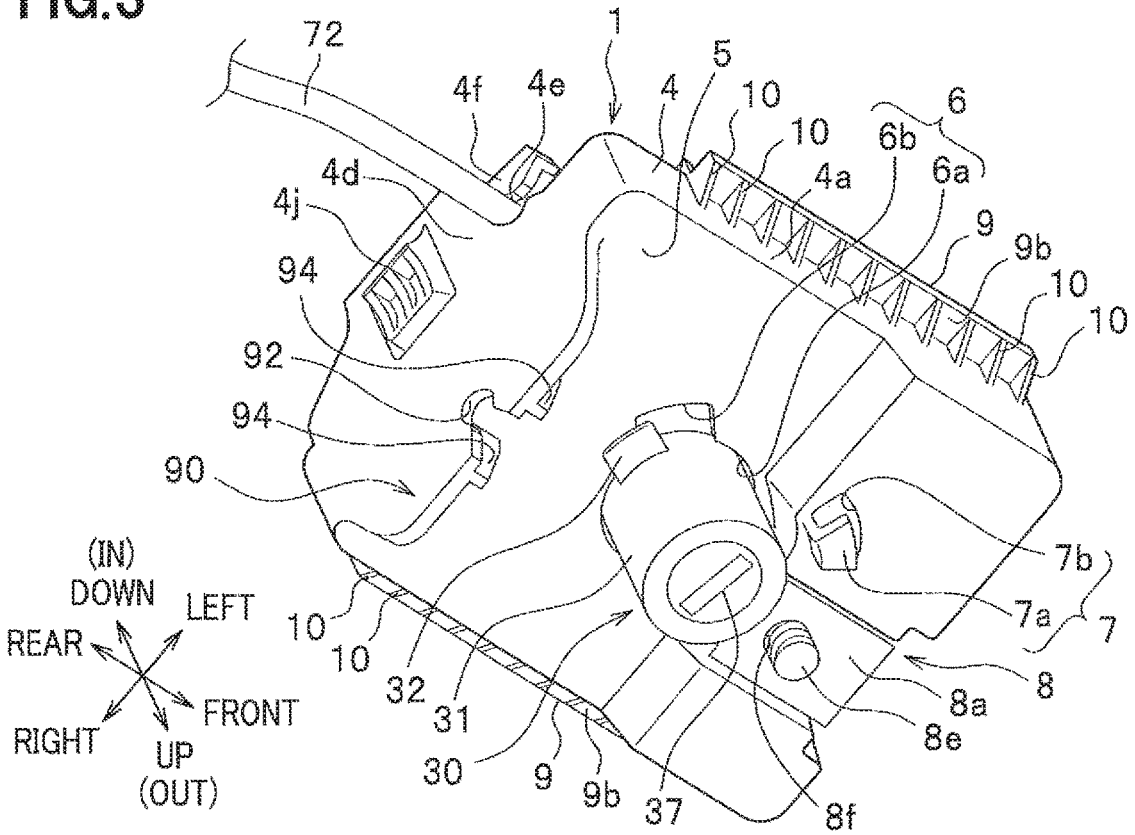
FIG. 3 is a perspective view showing the vehicle outer side face, as viewed from the other side, of the resin-made bracket.

Moreover, as shown in FIG. 2 and FIG. 3, the side wall parts 4*a*, 4*b* in this embodiment have a plurality of first ribs 10, 10. The first ribs 10, 10 are provided to vertically stand on the outer faces of the side wall parts 4*a*, 4*b* and to be directed outward from the outer faces, and integrally connect the side wall parts 4*a*, 4*b* with back faces 9*b* of the mounting flange 9, 9 with the side wall parts 4*a*, 4*b* and the back faces 9*b* being orthogonal to each other. Moreover, in the bracket 1 in this embodiment, the first ribs 10, 10 are arranged at practically equal intervals.

Furthermore, the frame-shaped part 4 in this embodiment has first engaging projections 4*h*, 4*h* and a second engaging projection 4*j*. The first engaging projections 4*h*, 4*h* are formed on aside wall part 4*c* orthogonal to the pair of side wall parts 4*a*, 4*b*. Moreover, the second engaging projection 4*j* is formed on a side wall part 4*d* that faces the side wall part 4*c* on which the first engaging projections 4*h*, 4*h* are formed, across the mounting part 3.

When the bracket 1 is mounted in a bracket mounting opening 42 of the first panel 40, the first engaging projections 4*h*, 4*h* and the second engaging projection 4*j* are adapted to be locked on an opening peripheral edge of the bracket mounting opening 42.

Figure 4:
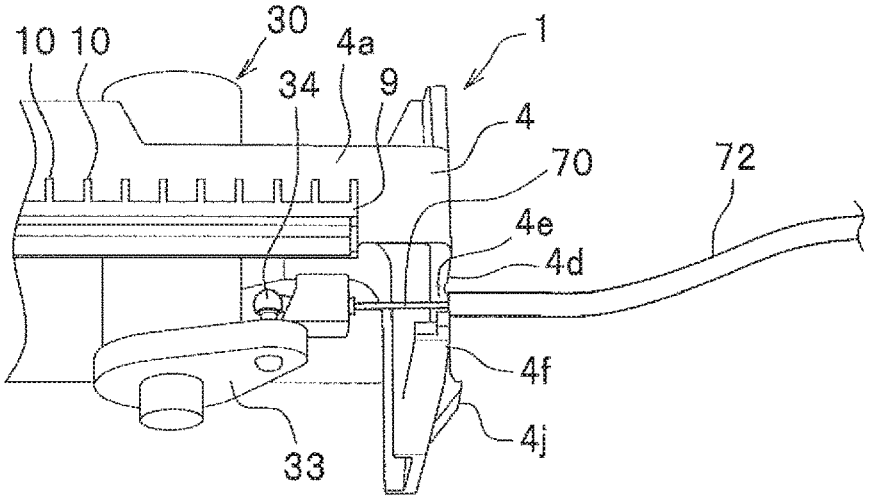
FIG. 4 is a side view for explaining a configuration on the periphery of a first cable that is attached to the resin-made bracket.
Figure 5:
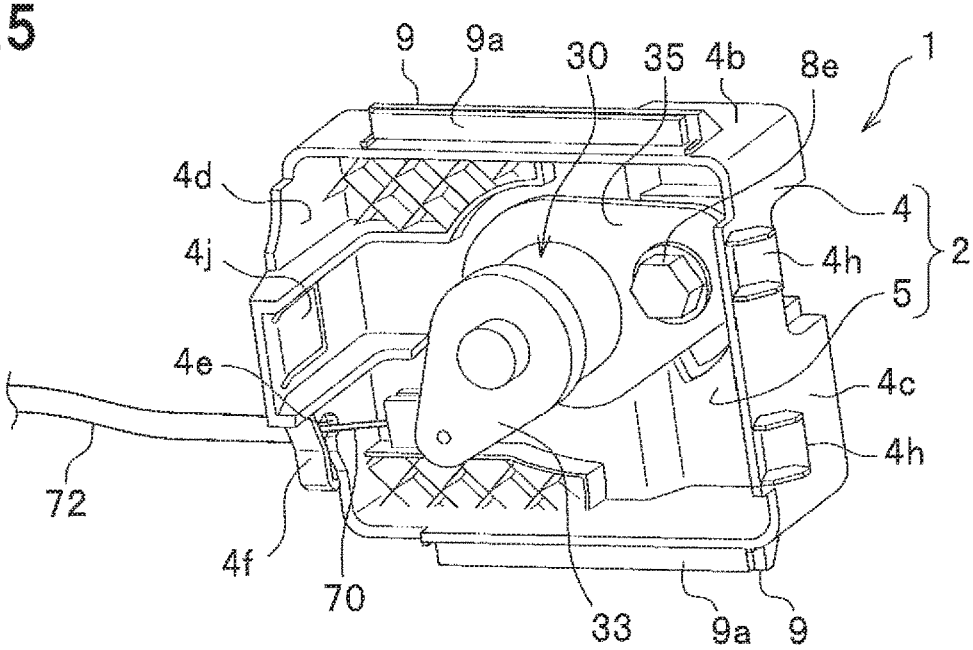
FIG. 5 is a perspective view showing a vehicle inner side face, as viewed from one side, of the resin-made bracket in the embodiment.
Figure 6:
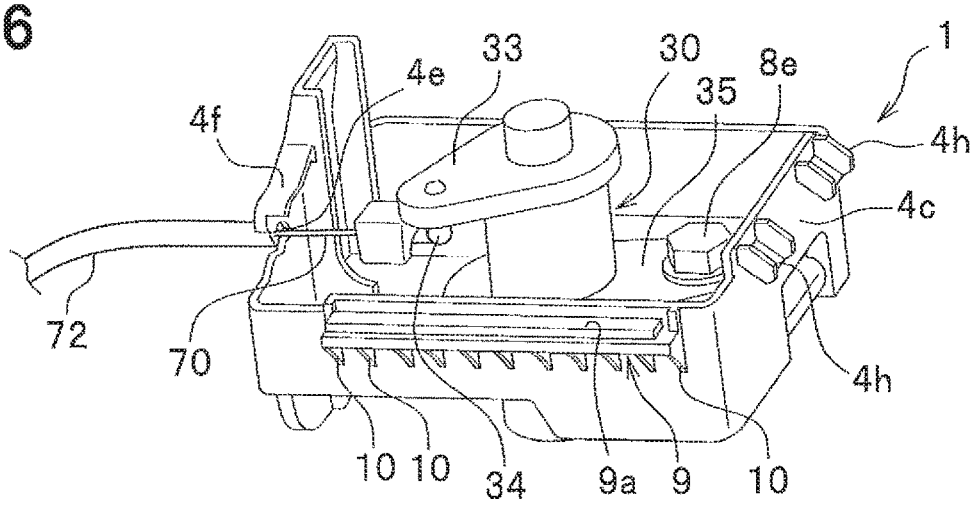
FIG. 6 is a perspective view showing the vehicle inner side face, as viewed from the other side, of the resin-made bracket.

As shown in FIG. 4 to FIG. 6, the frame-shaped part 4 has the insertion part 4*e* through which a first cable 70 connected to the key cylinder 30 is allowed to be inserted between the inside and the outside of the frame-shaped part 4, and a second rib 4*f* that is provided parallel with an extending direction of the first cable 70 inserted through the insertion part 4*e*.

The insertion part 4*e* and the second rib 4*f* are formed on the side wall part 4*d*. The second rib 4*f* may be formed using a slide die whose slide die-cutting direction is made parallel with the extending direction of the first cable 70.

The first cable 70 in this embodiment has an end part coupled via a ball joint 34 to a lever 33 of the key cylinder 30. The first cable 70 is slidably inserted through a covering tube 72 on the outer side than the insertion part 4*e*.

Moreover, an end part of the covering tube 72 is fitted in and fixed to the insertion part 4*e* having a cutout shape at the time of assembly. This makes it possible to allow the first cable 70 sliding in the covering tube 72 to be inserted through the insertion part 4*e* between the inside and the outside of the frame-shaped part 4.

As shown in FIG. 2 and FIG. 3, the base board 5 provided on the mounting part 3 further includes a locking claw 7*a* that composes the cable locking part 7 by which a second cable 80 (see the portion indicated by a two-dot chain line in FIG. 8) is locked on the vehicle outer side face of the base board 5, and a protruded wall part 90 that is protruded from a side edge of the base board 5 toward the side opposite to the frame-shaped part 4.

The protruded wall part 90 is provided with a second insertion part 92 having a cutout shape through which the second cable 80 is inserted, and a pair of third ribs 94, 94 that are formed parallel with an inserting direction of the second cable 80 in the second insertion part 92. The second cable 80 is slidably inserted through a covering tube 84.

Figure 7:
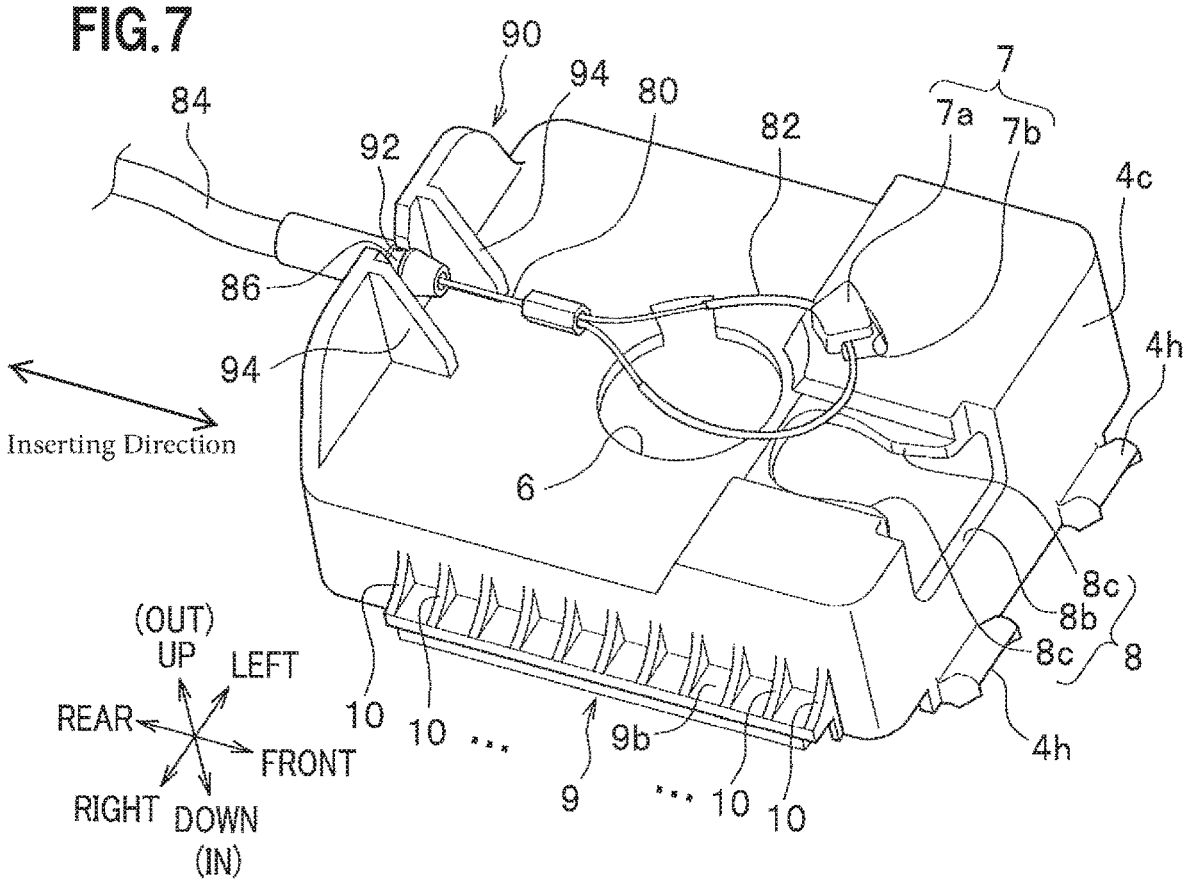
FIG. 7 is a perspective view for explaining a configuration on the periphery of a second cable that is attached to the resin-made bracket.

Moreover, as shown in FIG. 7, an end part 86 of the covering tube 84 is locked on and fixed to the second insertion part 92. This makes it possible to allow the second cable 80 sliding in the covering tube 84 to be inserted through the second insertion part 92 between the inside and the outside of the protruded wall part 90.

Moreover, as shown in FIG. 3, the bracket 1 in this embodiment allows the protruded wall part 90 located at the upper side from the base board 5 and the side wall part 4*d* located at the lower side from the base board 5 to be integrally provided so as to extend with a substantially constant dimension in the thickness direction and continuously in the vehicle width direction (right-left direction).

Furthermore, the protruded wall part 90 and the side wall part 4*d* are formed to allow outer surfaces thereof to be flush with each other except for a part protruding from the outer surfaces with the second engaging projection 4*j*. Consequently, the protruded wall part 90 and the side wall part 4*d* have very few parts on which stress is concentrated, thereby making it possible to disperse the stress in a well-balanced state.

The base board 5 in this embodiment has the pedestal part 5*b* formed to have a higher step than the planar part 5*a* in which the engaging hole 6 is formed.

On the other hand, the cable locking part 7 is formed on an edge part of the pedestal part 5*b* which is at the side near the protruded wall part 90. The cable locking part 7 has the locking claw 7*a* having a hook-like shape, and a die-cut hole 7*b*. The die-cut hole 7*b* is formed so as not to allow the locking claw 7*a* to overlap with the base board 5 in a face inner/outer direction (the cylinder axial direction L in FIG. 1) which is a die-cutting direction, and to penetrate through the pedestal part 5*b* in the face inner/outer direction.

Moreover, as shown in FIG. 7, an annular part 82 of the second cable 80 is locked on the locking claw 7*a* with the key cylinder 30 being not mounted. The locking claw 7*a* is provided on a part having relatively high rigidity of the pedestal part 5*b* where the stepped part having a higher step than the planar part 5*a* is formed. This makes it possible to enhance mounting rigidity.

Furthermore, the covering tube 84 of the second cable 80 is fitted in and mounted on the second insertion part 92 having a cutout shape of the protruded wall part 90. This makes it possible to allow the second cable 80 sliding in the covering tube 84 to be inserted through the second insertion part 92 between the inside and the outside of the protruded wall part 90, in the same manner as the first cable 70 inserted through the insertion part 4*e*.

The pedestal part 5*b* has the fixing part 8 provided adjacent to the locking claw 7*a* (see FIG. 7). As shown in FIG. 1 and FIG. 2, the fixing part 8 includes a slide fixing member 8*a*, a housing recessed part 8*b* adapted to house the slide fixing member 8*a*, slide guide parts 8*c*, 8*c* formed on both side faces of the housing recessed part 8*b*, respectively, and a fixing bolt 8*e* that is inserted through a fixing hole 8*d* formed in the fixing flange piece 35, and screwed into a female screw part 8*f* formed in the slide fixing member 8*a*.

As shown in FIG. 8, the bracket 1 is engaged with the bracket mounting opening 42 of the first panel 40 which is the inner panel of the vehicle body. At this time, the front end face 37 of the key cylinder 30 is inserted through a cylinder hole 52 that is formed by opening a flat face of the second panel 50, and headed for the vehicle inner side.

Next, description will be given of the workings and effects of the bracket structure according to the present embodiment.

First, description will be given of configuration in the case where the bracket 1 is provided on the vehicle body side mounting part 60 with the key cylinder 30 being mounted on the bracket 1.

As shown in FIG. 1, the key cylinder 30 is inserted through the engaging hole 6 formed in the base board 5 of the bracket 1, and allows the fixing flange piece 35 that is firmly fixed to the outside case 31, to be butted against the base board 5. With this state, the key cylinder 30 is turned around the cylinder shaft. This causes the projection 32 to be engaged with the opening peripheral edge of the round hole 6*a*.

Moreover, the slide fixing member 8*a* slides on the slide guide parts 8*c*, 8*c* formed on the housing recessed part 8*b* for engagement with the housing recessed part 8*b*. In this state, a turning angle of the key cylinder 30 is adjusted so as to allow the female screw part 8*f* formed in the slide fixing member 8*a* and the fixing hole to coincide with each other.

Next, the fixing bolt 8*e* is inserted through the fixing hole 8*d* formed in the fixing flange piece 35, and inserted through and screwed into the female screw part 8*f*. This causes the key cylinder 30 to be fixed to the bracket 1 with the key cylinder 30 being prevented from coming off from the engaging hole 6 of the bracket 1.

Then, as shown in FIG. 8, the bracket 1 is inserted into the bracket mounting opening 42 formed in the first panel 40 of the body, from the vehicle inner side toward the vehicle outer side.

The first engaging projections 4*h*, 4*h* and the second engaging projection 4*j* formed on the bracket 1 are locked on the opening peripheral edge of the bracket mounting opening 42. This causes the bracket 1 to be fixed to the vehicle body side mounting part 60 with the bracket 1 inserted halfway into the bracket mounting opening 42.

At this time, the abutting faces 9*a*, 9*a* of the mounting flanges 9, 9 shown in FIG. 1 abut on one side face of the peripheral edge part of the bracket mounting opening 42, and the amount of insertion of the bracket 1 is set so as to allow the mounting position in the engaging direction to be a proper position, thereby allowing the bracket 1 to be fixed.

At the mounting position, a part of the front end face 37 of the key cylinder 30 is nearly flush with the outer surface of the peripheral edge part of the cylinder hole 52. Note that in the illustration, the cylinder hole 52 is formed by opening the flat face of the second panel 50, but it may be concavely formed into a shape having a lower step than the outer surface of the second panel 50. Moreover, a lid body may be provided which is adapted to cover the front end face 37 of the key cylinder 30 and capable of being opened and closed.

As shown in FIG. 1, in the bracket 1 in this embodiment, the casing 2 formed of a resin material includes the mounting part 3 and the frame-shaped part 4. The frame-shaped part 4 is provided integral with the base board 5 so as to be erected from the peripheral edge of the base board 5 composing the mounting part 3 to be formed into an annular shape continuously in the peripheral direction.

Consequently, sufficient rigidity can be secured even if a resin material is used for the casing 2.

Moreover, the bracket 1 is formed into the shape such that the frame-shaped part 4 is erected from the peripheral edge of the base board 5 composing the mounting part 3. Consequently, resin mold using a metal mold can be easily performed by making a die-cutting direction in resin molding of the bracket 1 coincide with an erecting direction of the frame-shaped part 4.

Furthermore, the frame-shaped part 4 in this embodiment has the pair of side wall parts 4*a*, 4*b* facing each other across the mounting part 3, and the mounting flanges 9, 9 having an elongated shape are provided along the longitudinal direction of the side wall parts 4*a*, 4*b*, respectively. Moreover, as shown in FIG. 2 and FIG. 3, the plurality of first ribs 10, 10 are provided to vertically stand at practically equal intervals on the outer faces of the side wall parts 4*a*, 4*b* and to be directed outward from the outer faces, so as to connect the mounting flange 9, 9 with the side wall parts 4*a*, 4*b*, respectively.

Consequently, stress in the turning direction applied to the key cylinder 30 can be dispersed from the base board 5 of the mounting part 3 to the pair of side wall parts 4*a*, 4*b*, and received at the side wall parts 4*a*, 4*b* in a well-balanced state.

Therefore, rigidity of the entire bracket 1 can be enhanced.

In addition, when the bracket 1 is engaged with the bracket mounting opening 42, the mounting flanges 9, 9 and the first ribs 10, 10 in this embodiment allow the planar abutting faces 9*a*, 9*a* to abut on the vehicle outer side face of the first panel 40. This causes stress in the engaging direction to be dispersed from the mounting flanges 9, 9 via the plurality of first ribs 10, 10 to the entire bracket 1.

Thus, the abutting faces 9*a*, 9*a* of the mounting flanges 9, 9 reinforcing the side wall parts 4*a*, 4*b* are used to mount the bracket 1 in the bracket mounting opening 42, thereby making it possible to increase efficiency of mounting the parts and to further enhance rigidity of the entire bracket 1.

Furthermore, as shown in FIG. 1, the frame-shaped part 4 in this embodiment has the lattice-like distortion reinforcing parts 4*g*, 4*g* provided inside the corner parts thereof. The distortion reinforcing parts 4*g*, 4*g* are adapted to suppress generation of distortion or deformation such that the frame-shaped part 4 is distorted or deformed into a parallelogram.

Consequently, even if a load in the turning direction from the key cylinder 30 is further applied to the bracket 1, distortion of the bracket 1 can be suppressed.

Moreover, as shown in FIG. 4 to FIG. 6, the frame-shaped part 4 allows the first cable 70 connected to the key cylinder 30 to be inserted through the insertion part 4*e* between the inside and the outside of the frame-shaped part 4. The insertion part 4*e* has the second rib 4*f* that is provided parallel with the extending direction of the first cable 70.

Consequently, even if the first cable 70 is strained to allow a load in the extending direction of the first cable 70 to be applied to the frame-shaped part 4, the second rib 4*f* provided parallel with the extending direction suppresses distortion of the frame-shaped part 4.

Moreover, the second rib 4*f* is formed parallel with the extending direction. Consequently, with respect to the die-cutting direction when forming the bracket 1 made of resin, the second rib 4*f* does not interfere with the metal mold. This makes it possible to easily perform die-cutting in resin molding.

Next, description will be given of configuration in the case where the bracket 1 not having the key cylinder 30 mounted thereon is used.

As shown in FIG. 7, the annular part 82 of the second cable 80 is locked on the cable locking part 7 that is formed on the edge part of the pedestal part 5*b* which is at the side near the protruded wall part 90. Then, the second cable 80 is inserted through the second insertion part 92. This makes it possible, even in the case of the key cylinder 30 being not mounted, to allow the second cable 80 to be inserted through the second insertion part 92 between the inside and the outside of the protruded wall part 90, in the same manner as in the case where the first cable 70 is inserted through the insertion part 4*e*.

Moreover, the protruded wall part 90 is provided with the second insertion part 92 through which the second cable 80 is inserted, and the pair of third ribs 94, 94 formed parallel with the inserting direction of the second cable 80 in the second insertion part 92.

Consequently, even if the second cable 80 is strained to allow a load in the extending direction of the second cable 80 to be applied to the protruded wall part 90, the intended proof stress can be exhibited because the pair of third ribs 94, 94 is formed parallel with the inserting direction of the second cable 80.

On the other hand, the cable locking part 7 has the locking claw 7*a* and the die-cut hole 7*b*. The die-cut hole 7*b* is formed on the edge part of the pedestal part 5*b* which is at the side near the protruded wall part 90, so as not to allow the locking claw 7*a* to overlap with the base board 5 in the face inner/outer direction which is the die-cutting direction.

Consequently, the locking claw 7*a* having a hook-like shape does not overlap with the base board 5 having the die-cut hole 7*b* provided thereon, in the face inner/outer direction which is the die-cutting direction.

Therefore, formability can be improved because there is no part formed into an "under shape" at the time of die-cutting.

Moreover, the locking claw 7*a* of the cable locking part 7 can be formed into a hook-like shape. Consequently, the annular part 82 of the second cable 80 can be easily locked on the locking claw 7*a*.

Furthermore, as shown in FIG. 2 to FIG. 6, when the key cylinder 30 is turned using the key 20 in the case where the key cylinder 30 is mounted on the bracket 1, the first cable 70 coupled to the lever 33 can be strained.

Moreover, as shown in FIG. 7, the second cable 80 is strained by pulling the annular part 82 locked on the cable locking part 7, thereby making it possible to do the same workings as in the first cable 70. Consequently, for example, even in the state of failure in an electric system, a door or the like for a security space such as a trunk can be manually opened.

As described above, according to the present embodiment, the bracket 1 can be used in both the case where the key cylinder 30 is mounted on the bracket 1 (see the portion indicated by the solid line in FIG. 8) and the case where the key cylinder 30 is not mounted on the bracket 1 (see the portion indicated by the two-dot chain line in FIG. 8, and FIG. 7). Consequently, efficiency of mounting the parts can be increased.

Moreover, the bracket 1 is configured using a resin material. The bracket 1 is formed into the shape such that the frame-shaped part 4 is provided integral with the base board 5 so as to be erected from the peripheral edge of the base board 5 in the mounting part 3 to be continuously formed in the peripheral direction. This configuration is suitable for molding by means of injection molding of resin.

In addition, the bracket 1 made of resin makes it possible to achieve weight saving compared with a bracket made of metal. Moreover, the frame-shaped part 4 is integrally provided on the peripheral edge of the base board 5. The frame-shaped part 4 is configured using a resin material. Consequently, the bracket 1 can be easily mounted in the bracket mounting opening 42 with the first engaging projections 4*h*, 4*h* and the second engaging projection 4*j* provided on the frame-shaped part 4. Therefore, assemblability can be improved as compared to a conventional fastening structure.

Thus, the bracket 1 according to the present embodiment allows a bracket structure to be provided, which is capable of securing sufficient rigidity even if a resin material is used.

The present invention is not limited to the above embodiment and can be variously modified. The above embodiment is described by way of example for the purpose of explanation so as to easily comprehend the present invention, and thus the present invention is not necessarily limited to what is provided with all of the above described configurations. Moreover, a part of configurations in one embodiment can be substituted by a part of configurations in another embodiment, and a part of configurations in another embodiment can also be added to a part of configurations in one embodiment. Furthermore, with respect to a part of configurations in each embodiment, the part can be deleted, or another configuration can be added to or substituted for the part. Possible modifications to the above embodiment are, for example, as follows.

In the above embodiment, the mounting part 3 is configured to include the rectangular base board 5 having the vehicle inner side face formed into a planar shape as shown in FIG. 1. However, the shape of the base board 5 is not particularly limited to the disclosed embodiment, and may be other shapes, for example, such as a polygonal shape, an elliptic shape, and an oval shape. That is to say, as long as the front end face 37 of the key cylinder 30 is provided to project from the vehicle outer side face of the mounting part 3 as shown in FIG. 2, the mounting part 3 may be configured to include the base board 5 having any shape and dimension in the vehicle width direction.

Moreover, the frame-shaped part 4 is provided integral with the base board 5 so as to be erected from the peripheral edge on the vehicle inner side face of the base board 5 in the mounting part 3 to be continuously formed in the peripheral direction. However, the frame-shaped part 4 is not particularly limited to the disclosed embodiment, and only needs to be erected from at least one of the vehicle inner side face and the vehicle outer side face of the base board 5 in the mounting part 3. For example, parts facing each other on both sides of the frame-shaped part 4 only need to be provided integral with the base board 5 without being continuously formed in the peripheral direction.

Furthermore, the mounting flanges 9, 9 and the first ribs 10, 10 are provided along the peripheral direction on the outer faces of the side wall parts 4*a*, 4*b*, but they may be provided on the inner faces of the side wall parts 4*a*, 4*b*.

Moreover, as shown in FIG. 2, the first ribs 10, 10 are formed at practically equal intervals. However, the first ribs 10, 10 are not particularly limited to the disclosed embodiment, and may be provided to stand, for example, at unequal intervals. The shape, number and installation interval of the first ribs 10 may be optionally set.

Moreover, as shown in FIG. 4 to FIG. 6, the second rib 4*f* is provided on one side to be parallel with the extending direction of the first cable 70. However, the second rib 4*f* is not particularly limited to the disclosed embodiment, and for example, a pair of second ribs 4*f* may be provided on both sides of the first cable 70. As long as the second rib 4*f* is parallel with the extending direction of the first cable 70, the shape, number and arrangement position of the second rib 4*f* may be optionally set.

Furthermore, as shown in FIG. 2 or FIG. 7, the third ribs 94, 94 are provided on the protruded wall part 90 to be parallel with the inserting direction of the second cable 80, respectively. However, the third ribs 94, 94 are not particularly limited to the disclosed embodiment, and for example, a plurality of pairs of third ribs 94 may be provided. As long as the third ribs 94, 94 are formed parallel with the inserting direction of the second cable 80, the shape, number and arrangement position of the third ribs 94 may be optionally set.

In addition, the place where the bracket 1 is mounted is not particularly limited to the disclosed embodiment, too. That is, as long as the bracket 1 is used in opening a lid for a security space such as a trunk or a door, the bracket 1 may be provided in any part of the vehicle, for example, such as in the vicinity of the head part of an occupant seated in a rear seat.

Although the embodiment of the present invention has been described and illustrated in detail, the disclosed embodiment is made for purposes of illustration and example only and not limitation. The scope of the present invention should be interpreted by terms of the appended claims.

DESCRIPTION OF REFERENCE SIGNS

1: Bracket; 2: Casing; 3: Mounting part; 4: Frame-shaped part; 4*a*-4*d*: Side wall part; 4*e*: Insertion part; 4*f*: Second rib; 5: Base board; 6: Engaging hole; 7: Cable locking part; 7*a*: Locking claw; 7*b*: Die-cut hole; 9: Mounting flange; 10: First rib; 20: Key (Engaging part); 30: Key cylinder (Engaged part); 70: First cable; 80: Second cable; 90: Protruded wall part; 92: Second insertion part; 94: Third rib

What is claimed is:

1. A bracket structure formed as a case body and formed of a resin material, comprising:

a mounting part that is formed so as to allow an engaged part to be mounted thereon, the engaged part being operated by engagement with an engaging part; and a frame-shaped part that is erected from a peripheral edge of the mounting part to be continuously formed in a peripheral direction of the frame-shaped part, wherein the frame-shaped part includes a pair of side wall parts that face each other across the mounting part, and each of the side wall parts has a mounting flange formed in a peripheral direction of a corresponding side wall part and a first rib provided to vertically stand on an outer face of the corresponding side wall part and to be directed outward from the outer face, each of the side wall parts is connected via the first rib integrally with a corresponding back face of the mounting flange, with each of the side wall parts being orthogonal to its corresponding back face, the frame-shaped part has a distortion reinforcing part having a form of a lattice that is provided inside a corner part of the frame-shaped part, and the frame-shaped part includes a first insertion part through which a first cable connected to the engaged part is allowed to be inserted between an inside and an outside of the frame-shaped part, and a second rib provided parallel with an extending direction of the first cable inserted through the first insertion part.

2. A bracket structure formed as a case body and formed of a resin material, comprising:

a mounting part that is formed so as to allow an engaged part to be mounted thereon, the engaged part being operated by engagement with an engaging part; and a frame-shaped part that is erected from a peripheral edge of the mounting part to be continuously formed in a peripheral direction of the frame-shaped part, wherein the frame-shaped part includes a pair of side wall parts that face each other across the mounting part, and each of the side wall parts has a mounting flange formed in a peripheral direction of a corresponding side wall part and a first rib provided to vertically stand on an outer face of the corresponding side wall part and to be directed outward from the outer face, each of the side wall parts is connected via the first rib integrally with a corresponding back face of the mounting flange, with each of the side wall parts being orthogonal to its corresponding back face, the frame-shaped part has a distortion reinforcing part having a form of a lattice that is provided inside a corner part of the frame-shaped part, the mounting part is further provided with a cable locking part by which a cable is locked, and a protruded wall part that is protruded from the mounting part toward a side opposite to the frame-shaped part, and the protruded wall part is provided with an insertion part through which the cable is inserted, and another rib that is formed parallel with an inserting direction of the cable in the insertion part.

3. The bracket structure according to claim 2, wherein the cable locking part is provided with a locking claw, and a die-cut hole that is formed in the mounting part so as not to allow the locking claw to overlap with the mounting part in a die-cutting direction.

* * * * *